US009557039B2

(12) United States Patent
Cheng et al.

(10) Patent No.: US 9,557,039 B2
(45) Date of Patent: Jan. 31, 2017

(54) LIGHTING DEVICE, AND ILLUMINATING DEVICE INCLUDING THE LIGHTING DEVICE

(71) Applicant: Osram GmbH, Munich (DE)

(72) Inventors: Xiongjie Cheng, Shenzhen (CN); Aimin Lin, Shenzhen (CN); Xiaoqing Sun, Shenzhen (CN); Zuzhi Wang, Shenzhen (CN)

(73) Assignee: Osram GmbH, Munich (DE)

( * ) Notice: Subject to any disclaimer, the term of this patent is extended or adjusted under 35 U.S.C. 154(b) by 0 days.

(21) Appl. No.: 14/441,191

(22) PCT Filed: Oct. 16, 2013

(86) PCT No.: PCT/EP2013/071663

§ 371 (c)(1),
(2) Date: May 7, 2015

(87) PCT Pub. No.: WO2014/072158

PCT Pub. Date: May 15, 2014

(65) Prior Publication Data

US 2015/0260378 A1 Sep. 17, 2015

(30) Foreign Application Priority Data

Nov. 9, 2012 (CN) ..... 2012 1 0448864

(51) Int. Cl.
*F21V 19/00* (2006.01)
*F21V 29/76* (2015.01)
*F21Y 101/00* (2016.01)

(52) U.S. Cl.
CPC ..... *F21V 19/0035* (2013.01); *F21K 9/27* (2016.08); *F21V 19/004* (2013.01);
(Continued)

(58) Field of Classification Search
CPC .. F21V 17/164; F21V 19/0015; F21V 19/003; F21V 19/004; F21V 19/0035; F21V 23/005; F21V 29/004; F21V 29/2212; F21V 29/70; F21V 29/89; F21V 17/16; F21V 19/0045; F21V 21/14; F21V 23/06; F21V 29/713; F21V 29/74; F21V 29/763; F21Y 2101/02; F21Y 2105/001; F21Y 2103/003; F21Y 2113/005; H05K 2201/10106; F21K 9/00
See application file for complete search history.

(56) References Cited

U.S. PATENT DOCUMENTS 6,045,240 A * 4/2000 Hochstein ..... B60Q 1/2696 362/249.06
7,883,240 B2 * 2/2011 Lee ..... F21K 9/00 362/249.02

(Continued)

FOREIGN PATENT DOCUMENTS

CN 201487840 U 5/2010
CN 101956915 A 1/2011

(Continued)

OTHER PUBLICATIONS

International Search Report based on Application No. PCT/EP2013/071663 (4 Pages) dated Dec. 5, 2013 (Reference Purpose Only).

(Continued)

*Primary Examiner* — Hargobind S Sawhney
(74) *Attorney, Agent, or Firm* — Viering, Jentschura & Partner mbB

(57) ABSTRACT

Various embodiments may relate to a lighting device, including a housing, at least one light source, and a circuit board carrying the at least one light source. The housing defines a cavity for accommodating the at least one light source and the circuit board. The housing includes a bottom for carrying the circuit board. The lighting device further (Continued)

includes at least one separate mountable locking member, which is partially supported on the housing and presses the circuit board on the bottom. In addition, various embodiments further relates to an illuminating device including the lighting device.

12 Claims, 4 Drawing Sheets

(52) U.S. Cl.
CPC ..... *F21V 29/763* (2015.01); *F21Y 2101/00* (2013.01); *F21Y 2103/10* (2016.08); *F21Y 2115/10* (2016.08)

(56) References Cited

U.S. PATENT DOCUMENTS

2004/0233672 A1* 11/2004 Dubuc ..... A01G 9/24 362/294
2007/0053165 A1* 3/2007 Hsu ..... H05K 7/20963 361/715
2009/0244909 A1* 10/2009 Chen ..... F21V 19/0045 362/368
2009/0290346 A1* 11/2009 Ogawa ..... F21K 9/00 362/249.01
2011/0176308 A1* 7/2011 Wu ..... F21V 29/89 362/247
2011/0310624 A1* 12/2011 Preuschl ..... F21V 29/70 362/373
2012/0206917 A1* 8/2012 Burkard ..... F21V 17/164 362/249.01
2012/0242226 A1* 9/2012 Preuschl ..... F21V 23/06 315/71
2013/0121759 A1 5/2013 Breidenassel et al.
2013/0314917 A1 11/2013 Su

FOREIGN PATENT DOCUMENTS

CN WO 2012019535 A1 * 2/2012 ..... F21K 9/17
CN EP 2413021 B1 * 5/2015 ..... F21S 8/086
DE 102007038787 A1 2/2009
DE 102010031312 A1 * 1/2012 ..... F21V 7/00
TW M438603 U 10/2012
WO 2012007413 A1 1/2012
WO 2013007450 A1 1/2013

OTHER PUBLICATIONS

Chinese Office Action based on application No. 2012104488640 (7 pages) dated Oct. 27, 2016 (Reference Purpose Only).

* cited by examiner

LIGHTING DEVICE, AND ILLUMINATING DEVICE INCLUDING THE LIGHTING DEVICE

RELATED APPLICATIONS

The present application is a national stage entry according to 35 U.S.C. §371 of PCT application No.: PCT/EP2013/071663 filed on Oct. 16, 2013, which claims priority from Chinese application No.: 201210448864.0 filed on Nov. 9, 2012, and is incorporated herein by reference in its entirety.

TECHNICAL FIELD

Various embodiments relate to a lighting device, and an illuminating device including the lighting device.

BACKGROUND

In the Lighting devices widely used in offices, shops, homes, etc., a fastening member such as a screw or an adhesive such as glue is generally needed to fix a lighting device in a housing or on a heat sink, for example, a large number of screws are used to fix the lighting device on the heat sink to ensure a favorable thermal conduct path between the lighting device and the heat sink.

If the fastening member is used for fixing, the positional relationship between the fastening member and the lighting device is usually limited by the manufacturing requirements, for example, as there are strict requirements on the spacing between electrical components and metal screws, the use of a large number of screws on the board affects adversely the circuit layout, and causes extra difficulties on the manufacturing (the production efficiency is lowered) and product maintenance.

If only the adhesive such as glue is relied on instead of using the fastening member to fix, for example, adhering the lighting device to the heat sink using a thermal conduct adhesive, unsafe factors arise when the volume or weight of the lighting device is relatively large, e.g., in the tube-shaped Lighting device which is relatively long, the use of glue might cause accidents and mistaken adhesion caused by thermal expansion might result in potential separation/bending.

SUMMARY

Various embodiments provide a lighting device, which is fixed tightly in a housing without using an additional fastening member or adhesive, thereby reducing the number of the used components and facilitating installation and maintenance.

The lighting device includes: a housing, at least one light source, and one circuit board carrying the at least one light source, wherein the housing defines the cavity that accommodates the at least one light source and circuit board and includes the bottom carrying the circuit board, characterized in that the Lighting device further includes at least one separate mountable locking member, which is partially supported on the housing and presses the circuit board on the bottom.

In various embodiments, the manner of using the fastening member to assemble the lighting device including the circuit board and light source and the housing together is discarded, instead, a locking member with a special configuration is installed in a housing further designed with a special configuration, so as to fix the circuit board on the bottom of the housing in a pressing manner according to the geometric and mechanical principles. Therefore, various defects brought by the fixing with the fastening member and the adhesive are overcome and the number of the used components is advantageously reduced.

According to various embodiments, the housing includes the bottom and side walls extending from at least a part of the bottom, wherein the side walls support the locking member. The side wall is able to provide side supporting force for the locking member, which partially converts the supporting force to a pressing force for pressing the circuit board.

According to various embodiments, the bottom includes a first section and a second section, wherein the second section protrudes upward in relation to the first section, and the second section includes the top surface supporting the circuit board and the side surface supporting the locking member. A boss for carrying the circuit board is thereby able to be formed on the bottom, and the locking member operates with the side surface of the boss to press the circuit board on the boss.

According to various embodiments, the second section and side walls define a side gap in which the locking member is accommodated. The locking member may be an elastic clamping member, which clamps the circuit board and the second section. The locking member is able to be locked in the gap under the conditions of supporting the stress. Under such conditions, the locking member ensures to be fastened together with the housing on the one hand, and ensures to fix the circuit board on the second section on the other hand.

According various embodiments, there are two locking members which clamp two longitudinal edges of the circuit board on the bottom, respectively.

According to various embodiments, the locking member includes a first end for pressing the circuit board and a second end for pressing the second section and an intermediate portion between the first end and the second end, and the side wall supports intermediate portions. The first end and second end are able to be used on the clamping ends here; therefore, the locking member has the clamping function.

The second section may have a T-shaped cross section 65 perpendicular to the bottom and include a first part and a second part in the sequence from top to bottom, wherein the second end press the first part. Namely, the side of the second part facing the circuit board has a larger width in the cross section, while the side of the second part near the first part has a smaller width in the cross section.

The locking member may further include the outer side surface facing to the side wall, wherein the outer side surface includes a first outer side surface section against the side wall form-fit at the side of the first end, and a second outer side surface section extended obliquely in relation to the first section. The outer surface of the locking member far from the second section may have a 7-shaped curved contour in cross section. By virtue of the second outer side surface section that extends obliquely, the locking member is able to be simply inserted into the gap, and interlocked with the housing, thereby fixing the circuit board on the second section.

The locking member may further include the inner side surface facing away the side wall, wherein the inner side surface includes a first press section against the circuit board form-fit at the side of the first end, and a second press section against the second section form-fit. The inner side surface of the locking member, the end of the circuit board, and the side surface of the second section press each other, thereby to exert stress on the circuit board in the direction upright to the circuit board and fix the circuit board on the second section.

According to various embodiments, the side surface is an oblique plane in relation to the first section. Preferably, the side walls are perpendicular to the first section, and the gap has a rectangular trapezium contour in the cross section.

According to various embodiments, the side surface S2 has a step surface. The side walls may be perpendicular to the first section, and the gap has an L-shaped contour in the cross section.

According to various embodiments, the locking member further includes a structure to lock with the circuit board, which includes at least one protruding part extended from the first end and at least one groove arranged on the circuit board.

The housing may be a heat sink. Therefore, materials strong in heat conduction, e.g. metals, may be selected to produce the housing.

In addition, various embodiments relate to an illuminating device including a cover, characterized in that the illuminating device further includes the above Lighting device, wherein the cover and Lighting device define the enclosed space that accommodates at least one light source and the circuit board carrying the at least one light source. The illuminating device may have a tubular contour. Such illuminating devices are able to be used as T5 or T8 lamps.

BRIEF DESCRIPTION OF THE DRAWINGS

In the drawings, like reference characters generally refer to the same parts throughout the different views. The drawings are not necessarily to scale, emphasis instead generally being placed upon illustrating the principles of the disclosed embodiments. In the following description, various embodiments described with reference to the following drawings, in which.

DETAILED DESCRIPTION

In the following detailed description, reference is made to the accompanying drawings, which form a part hereof, and in which is shown by way of illustration specific embodiments in which the utility model may be practiced. In this regard, directional terminology, such as "top", "bottom", "front", "back", "up", "down", is used in reference to the orientation of the figures being described. Because components of embodiments of the present utility model can be positioned in a number of different orientations, the directional terminology is used for purposes of illustration and is in no way limiting.

It is to be understood that other embodiments may be utilized and structural or logical changes may be made without departing from the scope of the present utility model. The following detailed description, therefore, is not to be taken in a limiting sense, and the scope of the present utility model is defined by the appended claims.

Figure 1:
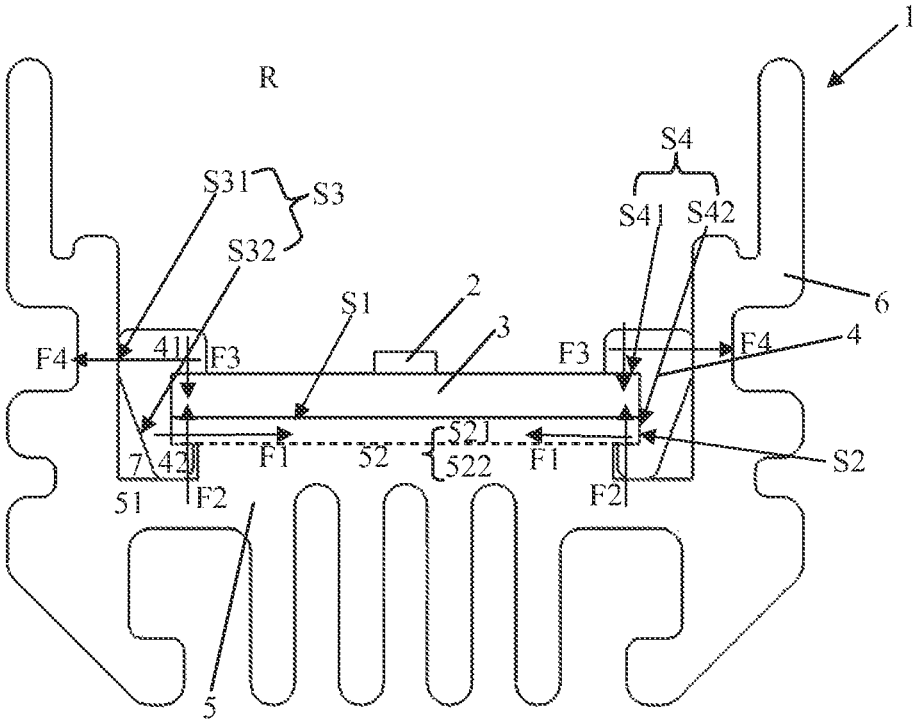
FIG. 1 is a cross-sectional view of a first embodiment of the Lighting device according to the present disclosure.

FIG. 1 is a cross-sectional view of a first embodiment of the Lighting device according to the present disclosure. A Lighting device 10 includes a housing 1 and a lighting device including a light source 2 and a circuit board 3 carrying a plurality of light sources 2. The housing 1 has a groove-shaped contour that defines a space R, and the lighting device is arranged in the middle of the bottom 5 of the housing 1. A plurality of light sources 2 are arranged, e.g. into a linear shape; therefore, merely one light source 2 is shown in the cross section.

For the fastening of a lighting device, specially a circuit board 3 on the bottom 5, a locking member 4 for fastening the circuit board 3 is additionally mounted in the housing 1. By virtue of the special configuration, the locking member 4 is fastened in the housing 1 in the form of insertion, and fixes the circuit board 3 on the bottom 5 of the housing 1 by means of press according to the geometric and mechanical principles.

Figure 2:
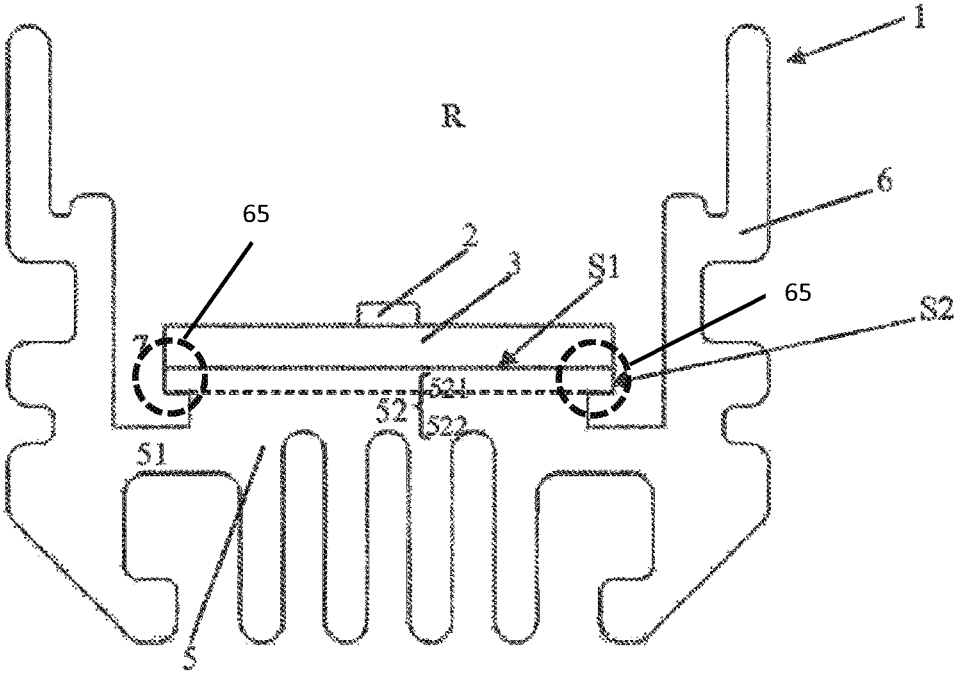
FIG. 2 is a cross-sectional view of the housing in FIG. 1.

Now, the Lighting device 10 according to the present disclosure will be explained in detail in combination with the housing 1 and locking member 4 shown respectively in FIGS. 2 and 3.

The housing 1 whose bottom is designed as a heat sink includes the bottom 5 and side walls 6 extending vertically from the bottom 5 at both sides. In order to form an gap 7 for accommodating the locking member 4, the bottom 5 is specially designed to include a first section 51 that connects with side walls 6 and a second section 52 that protrudes upward in relation to the first section 51. The second section 52 has a substantially T-shaped cross section 65 perpendicular to the bottom 5 and includes a first part 521 for carrying the circuit board 3 and a second part 522 connecting with the first section 51. The surface of the first part 521 for carrying the circuit board 3 is a top surface S1, and the side surface extending from the top surface S1 to the first section 51 is a side surface S2 of the second section 52. In the present embodiment, the side surface S2 trends like a step, and is therefore able to co-define the L-shaped gap 7 with the side wall 6.

The locking member 4 that can be accommodated easily in the gap 7 has a bending contour, and fixes the circuit board 3 on the top surface S1 as a locking section. For the convenience of inserting the locking member 4 simply into the housing 1, elastic materials are able to be selected to produce the locking member 4, thereby to make the locking member endure a certain stress during the assembly.

The locking member 4 includes a first end 41 pressing the circuit board 3 and leaning on the side wall 6 and a second end 42 pressing the second section 52 specially its side wall S2. As the second end 42 does not need to lean on the side wall 6, the width of the second end in the cross section is able to be designed very small, such that the second end is able to be inserted into the gap 7 and press the side surface S2.

An outer side surface S3 of the locking member 4 extends from the first end 41 to the second end 42 at the side towards side wall 6, including a first outer side surface section S31 at the side of the first end 41 and against the side wall 6 form-fit in the upper part of the figure, and a second outer side surface section S32 slanting refer to the first section 51, e.g. extending at a 20° angle with the side wall 6. Under the conditions that the elasticity of the locking member 4 is large enough, the angle between the second outer side surface section S32 and the side wall is able to be decreased accordingly.

An inner side surface S4 of the locking member 4 extends from the first end 41 to the second end 42 at the side towards the second section 52, including a first press section S41 at the side of the first end 41 and pressing the edge area of the circuit board 3 form-fit in the upper part of the figure, and a second press section S42 between the circuit board 3 and the first section 51 pressing the second section 52 form-fit.

The side supporting force that the side wall 6 provides to the locking member 4 is passed to the circuit board 3 and the second section 52, thereby pressing the circuit board 3 on the second section 52 by the locking member 4. Thus, the first press section S41 is closely pressed together with the edge area of the circuit board 3, and exerts a vertical press F3 and a horizontal press F4 to the marginal area as shown in FIG. 1. The second press section S42 is closely pressed together with the side wall S2 of the second section 52, and exerts a pair of horizontal supporting forces F1 and a vertical supporting force F2 to the side wall S2 as shown in FIG. 1.

In an unshown second embodiment, the side surface of the second section is an oblique plane in relation to the first section, and is therefore able to co-define with the side wall the gap having a rectangular trapezium contour in the cross section. Under such conditions, the second press section of the locking member is designed as an oblique plane in relation to the first press section.

Figure 3:
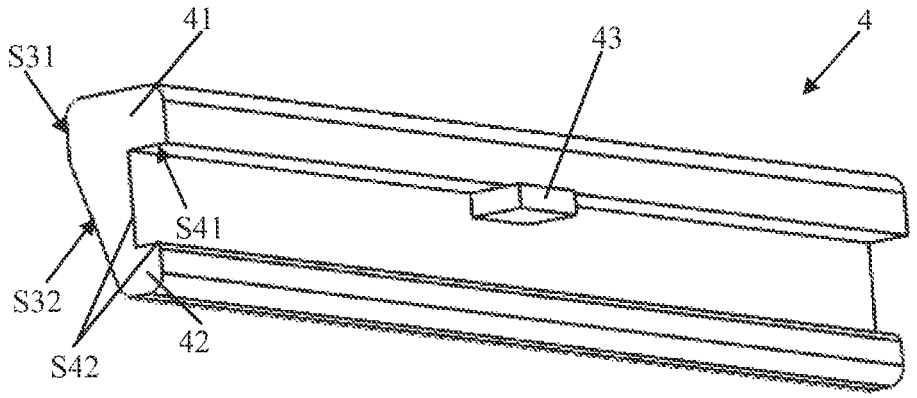
FIG. 3 is a 3D view of the locking member in FIG. 1.

In addition, as shown in FIG. 3, the locking member 4 further includes a protruding part 43 that extends from the first press section S41. The protruding part 43 is able to stretch into the preset groove of the circuit board 3 during assembly, thereby to ensure that the locking member 4 and the circuit board 3 are relatively fixed along the direction of extension of the circuit board.

Figure 4:
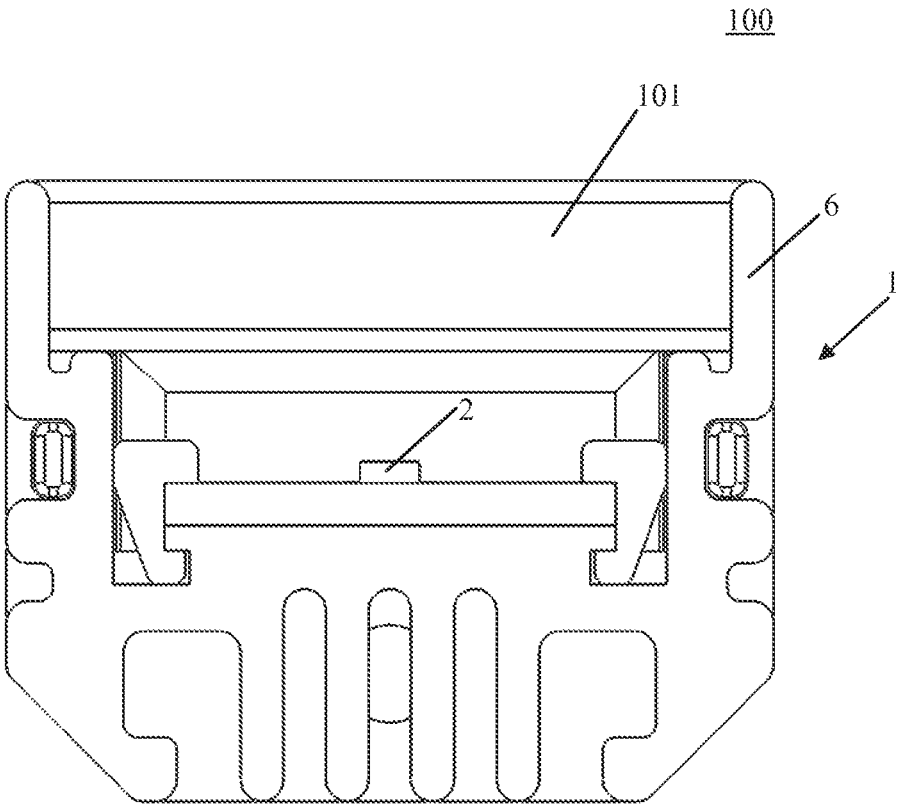
FIG. 4 is a cross-sectional view of a first embodiment of the illuminating device according to the present disclosure.

FIG. 4 is a cross-sectional view of a first embodiment of the illuminating device according to the present disclosure. An illuminating device 100 with a tubular contour includes the Lighting device 10 shown in FIG. 1 and a cover 101 for closing the opening of the housing 1. The cover 101 is able to be formed on the housing 1 in proper encapsulation methods such as injection molding. Or, the cover 101 may be designed as a top cover, and held form-fit between the two side walls 6 in shape by virtue of its special shape, specially the marginal areas in contact with the housing 1.

When the light source 2 is an LED light source, such an illuminating device can be used as a remodeling lamp to replace T5 or T8 fluorescent lamps in the current technology.

While the disclosed embodiments have been particularly shown and described with reference to specific embodiments, it should be understood by those skilled in the art that various changes in form and detail may be made therein without departing from the spirit and scope of the disclosed embodiments as defined by the appended claims. The scope of the disclosed embodiments is thus indicated by the appended claims and all changes which come within the meaning and range of equivalency of the claims are therefore intended to be embraced.

The invention claimed is:

1. A lighting device, comprising:

a housing, at least one light source, and a circuit board carrying the at least one light source, wherein the housing defines a cavity for accommodating the at least one light source and the circuit board, wherein the housing comprises a bottom for carrying the circuit board, wherein the lighting device further comprises at least one separate mountable locking member, which is partially supported on the housing and presses the circuit board on the bottom, wherein side wall extending from at least one part of the bottom, wherein the side wall supports the locking member, wherein the bottom comprises a first section and a second section, the second section protrudes upward in relation to the first section, and the second section comprises a top surface supporting the circuit board and a side surface supporting the locking member, wherein the locking member is an elastic clamping member, which clamp the circuit board and the second section, wherein the locking member comprises a first end pressing the circuit board and a second end pressing the second section, and an intermediate portion between the first end and the second end, and the side wall supports intermediate portions, wherein the second section has a T-shaped cross section perpendicular to the bottom and comprises a first part and a second part in the sequence from top to bottom, wherein the second end press the first part.

2. A lighting device according to claim 1, wherein the second section and the side wall define a side gap in which the locking member is accommodated.

3. A lighting device according to claim 1, wherein there are two locking members which clamp two longitudinal edges of the circuit board on the bottom, respectively.

4. A lighting device according to claim 1, wherein the locking member further comprises the outer side surface facing to the side wall, wherein the outer side surface comprises a first outer side surface section against the side wall form-fit at the side of the first end, and a second outer side surface section extended obliquely in relation to the first section.

5. A lighting device according to claim 1, wherein the side surface is an oblique plane in relation to the first section.

6. A lighting device according to claim 1, wherein the side surface has a step surface.

7. A lighting device according to claim 1, wherein the housing is a heat sink.

8. A lighting device comprising:

a housing, at least one light source, and a circuit board carrying the at least one light source, wherein the housing defines a cavity for accommodating the at least one light source and the circuit board, wherein the housing comprises a bottom for carrying the circuit board, wherein the lighting device further comprises at least one separate mountable locking member, which is partially supported on the housing and presses the circuit board on the bottom, wherein side wall extending from at least one part of the bottom, wherein the side wall supports the locking member, wherein the bottom comprises a first section and a second section, the second section protrudes upward in relation to the first section, and the second section comprises a top surface supporting the circuit board and a side surface supporting the locking member, wherein the locking member is an elastic clamping member, which clamp the circuit board and the second section, wherein the locking member comprises a first end pressing the circuit board and a second end pressing the second section, and an intermediate portion between the first end and the second end, and the side wall supports intermediate portions, wherein the locking member further comprises a structure to lock with the circuit board, which comprises at least one protruding part extended from the first end and at least one groove arranged on the circuit board.

9. An illuminating device, comprising a cover, and a lighting device, the lighting device comprising:

a housing, at least one light source, and a circuit board carrying the at least one light source, wherein the housing defines a cavity for accommodating the at least one light source and the circuit board, wherein the housing comprises a bottom for carrying the circuit board, wherein the lighting device further comprises at least one separate mountable locking member, which is partially supported on the housing and presses the circuit board on the bottom, wherein the cover and lighting device define the enclosed space that accommodates at least one light source and the circuit board carrying the at least one light source, wherein side wall extending from at least one part of the bottom, wherein the side wall supports the locking member, wherein the bottom comprises a first section and a second section, the second section protrudes upward in relation to the first section, and the second section comprises a top surface supporting the circuit board and a side surface supporting the locking member, wherein the locking member is an elastic clamping member, which clamp the circuit board and the second section, wherein the locking member comprises a first end pressing the circuit board and a second end pressing the second section, and an intermediate portion between the first end and the second end, and the side wall supports intermediate portions, wherein the second section has a T-shaped cross section perpendicular to the bottom and comprises a first part and a second part in the sequence from top to bottom, wherein the second end press the first part.

10. An illuminating device according to claim 9, wherein the illuminating device has a tubular contour.

11. A illuminating device according to claim 9, wherein the bottom comprises a first section and a second section, the second section protrudes upward in relation to the first section, and the second section comprises a top surface supporting the circuit board and a side surface supporting the locking member.

12. A illuminating device according to claim 9, wherein the housing is a heat sink.

* * * * *